US009087460B2

(12) United States Patent
Maier-Hunke

(10) Patent No.: US 9,087,460 B2
(45) Date of Patent: Jul. 21, 2015

(54) NAME BADGE

(75) Inventor: Horst-Werner Maier-Hunke, Iserlohn (DE)

(73) Assignee: Durable Hunke & Jochheim GmbH U Co. KG, Iserlohn (DE)

( * ) Notice: Subject to any disclaimer, the term of this patent is extended or adjusted under 35 U.S.C. 154(b) by 899 days.

(21) Appl. No.: 11/992,443

(22) PCT Filed: Sep. 16, 2006

(86) PCT No.: PCT/EP2006/009039
§ 371 (c)(1),
(2), (4) Date: Mar. 16, 2009

(87) PCT Pub. No.: WO2007/033804
PCT Pub. Date: Mar. 29, 2007

(65) Prior Publication Data

US 2009/0183400 A1 Jul. 23, 2009

(30) Foreign Application Priority Data

Sep. 22, 2005 (DE) ..... 10 2005 046 466

(51) Int. Cl.
*A44C 3/00* (2006.01)
*G09F 3/20* (2006.01)

(52) U.S. Cl.
CPC ..... *G09F 3/207* (2013.01)

(58) Field of Classification Search
CPC ..... A44C 3/001; G09F 3/20
USPC ..... 40/1.5, 1.6, 469, 669, 661, 661.04, 40/661.08
See application file for complete search history.

(56) References Cited

U.S. PATENT DOCUMENTS

| | | | | |
|---|---|---|---|---|
| 5,067,265 | A * | 11/1991 | Harms | 40/1.5 |
| 5,613,602 | A * | 3/1997 | Lage et al. | 206/232 |
| 5,664,292 | A * | 9/1997 | Chen | 24/3.11 |
| 6,170,181 | B1 * | 1/2001 | Groner | 40/1.6 |
| 2003/0200690 | A1 * | 10/2003 | Galloway | 40/779 |
| 2004/0163990 | A1 * | 8/2004 | Begim | 206/472 |
| 2007/0022794 | A1 * | 2/2007 | Maier-Hunke | 70/456 R |

FOREIGN PATENT DOCUMENTS

| | | | |
|---|---|---|---|
| DE | 8329887 | U1 | 12/1983 |
| DE | 29718742 | | 1/1998 |
| EP | 0608043 | | 7/1994 |
| EP | 0608043 | B1 | 7/1994 |
| EP | 1174846 | | 1/2002 |

* cited by examiner

*Primary Examiner* — Charles A Fox
*Assistant Examiner* — Shin Kim
(74) *Attorney, Agent, or Firm* — Mark P. Stone

(57) ABSTRACT

The invention relates to a name badge comprising an attachment device (3) which comprises a base (20) and two cheeks (29, 30) which are arranged at a distance from each other, in addition to a clamping element (27) which is pivotably mounted between the cheeks (29, 30). The attachment device (3) is held by a mounting (8), which is embodied in the form of a frame (10, 13) which at least partially surrounds the attachment device and comprises holding down clamps (16, 17) for the base (20).

22 Claims, 5 Drawing Sheets

NAME BADGE

TECHNICAL FIELD

The invention relates to a name badge with an attachment device, which is used for attaching the said badge to an item of clothing and which has a base and two cheeks arranged spaced from one another as well as a double-armed clamping element, which is supported pivotably on a pivot axle that is supported in the cheeks, wherein one arm of said clamping element is pressed against the base by a spring.

STATE OF THE ART

Attachment devices for name badges of the type under consideration and known from page 140 of the applicant's catalogue for 2001 are offered in large quantities from a few specialist companies and in particular in the form of so-called combination clamps, i.e. in conjunction with a safety pin, which is held by one arm of the clamping element and the spring. With known name badges the described attachment devices are normally joined to the rear wall of the respective name badge by adhesive. This type of manufacture of name badges always leads to flawless results if suitable adhesive is found for the respective material pair, wherein practically only quick-acting adhesives can be considered due to production reasons. If it is considered that also quick-acting adhesives need a certain time to bond and are normally not free of solvent, then it is found that on the grounds of cost savings and also environmental pollution due to the release of solvent it is preferable to seek ways which render an adhesive process dispensable. An appropriate method is illustrated in EP 0 608 043 B1 in which the base of the attachment device has a hole into which a spigot with a mushroom-shaped retaining head can be introduced at its free end. This known solution may not be completely satisfactory for two reasons. The first reason is that the commercially available attachment device has to be provided with a hole which weakens the base; the second reason is that the retaining head projects into the clamping region of the clamping element and impedes fitting the name badge to an item of clothing.

A price labelling sign, which is not intended for attachment to an item of clothing and which is described in DE 83 29 887, has on its rear side projections formed as a type of short dovetailed guide, between which a flat material strip can be pushed, which at its free, tapered end is provided with barbs on both sides which engage the projections. The Known arrangement is not suitable for the mounting of attachment devices of the type of interest here.

DESCRIPTION OF THE INVENTION

The object of the invention is to find an alternative to the known arrangement from EP 0 608 043 B1 which renders a modification of the base of the attachment device superfluous and which does not impair the attachment process. This object is solved according to the invention in that the name badge has a mounting, which is formed as a type of frame at least partially enclosing the base of the attachment device, the said frame being provided with holding down clamps for the base in the region of the attachment device located outside of the cheeks.

The name badge according to the invention offers the advantage that its mounting facilitates trouble-free joining of commercially available attachment devices of the type described in the introduction to the name badge, wherein it has been proven to be particularly advantageous to form the mounting as an integral component of the rear wall of a name badge.

Further details of the name badge according to the invention are given in the following description of several embodiments of the invention illustrated in the included drawing.

BRIEF DESCRIPTION OF THE DRAWINGS

The following are shown:

In FIGS. 1 to 15 the front wall of a name badge is designated with 1 and the rear wall is designated with 2. An attachment device 3 in the form of a known, so-called combination clamp is used to attach the said badge to an item of clothing. The front wall 1 is connected to the rear wall 2 by two pivot bearings 4 and 5 formed by film hinges. The front wall 1, rear wall 2 and the pivot bearings 4, 5 are composed of one piece, formed as an injection moulded component.

Figure 1:
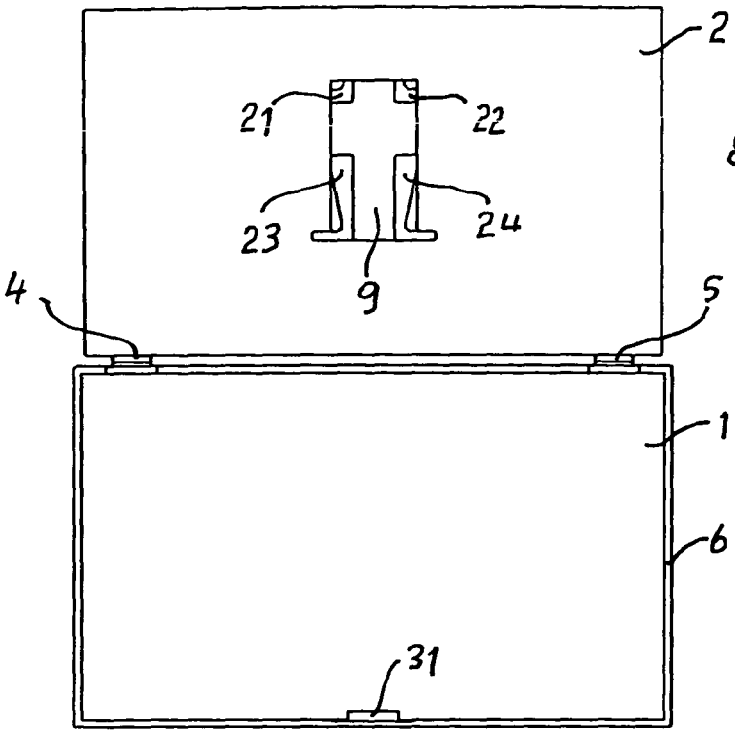
FIG. 1 the plan view onto the inner sides of an open name badge with a mounting for a combination clamp, FIG. 2 the side view of the name badge according to FIG. 1, FIG. 3 the plan view onto the outer sides of the open name badge according to FIGS. 1 and 2, FIG. 4 a section along the line IV-IV through the name badge according to FIG. 3, FIG. 5 a plan view corresponding to FIG. 1 onto the inner side of an open name badge, provided with a combination clamp, according to FIGS. 1 to 4, FIG. 6 the side view of the name badge according to FIG. 5, FIG. 7 a plan view corresponding to FIG. 3 onto the outer sides of the name badge, provided with a combination clamp, according to FIG. 5, FIG. 8 a section along the line VIII-VIII in FIG. 7, FIG. 9 the perspective view in enlarged scale of the mounting for the combination clamp used for the name badge according to the FIGS. 1 to 8, FIG. 10 the plan view onto the mounting according to FIG. 9, FIG. 11 a section along the line XI-XI in FIG. 10, FIG. 12 a section along the line XII-XII in FIG. 10, FIG. 13 the insertion of a combination clamp into the mounting according to FIGS. 9 to 12, FIG. 14 the pivoting of the combination clamp into its intended position, FIG. 15 the end position of the captive combination clamp arranged in the mounting, FIG. 16 the perspective illustration of a variant of the mounting illustrated in the previous figures, FIG. 17 the plan view onto the mounting according to FIG. 16, FIG. 18 a section along the line XVIII-XVIII in FIG. 17 and FIG. 19 a section along the line XIX-XIX in FIG. 17.
Figure 2:
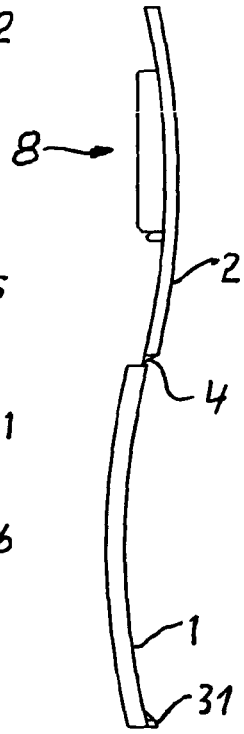
Figure 3:
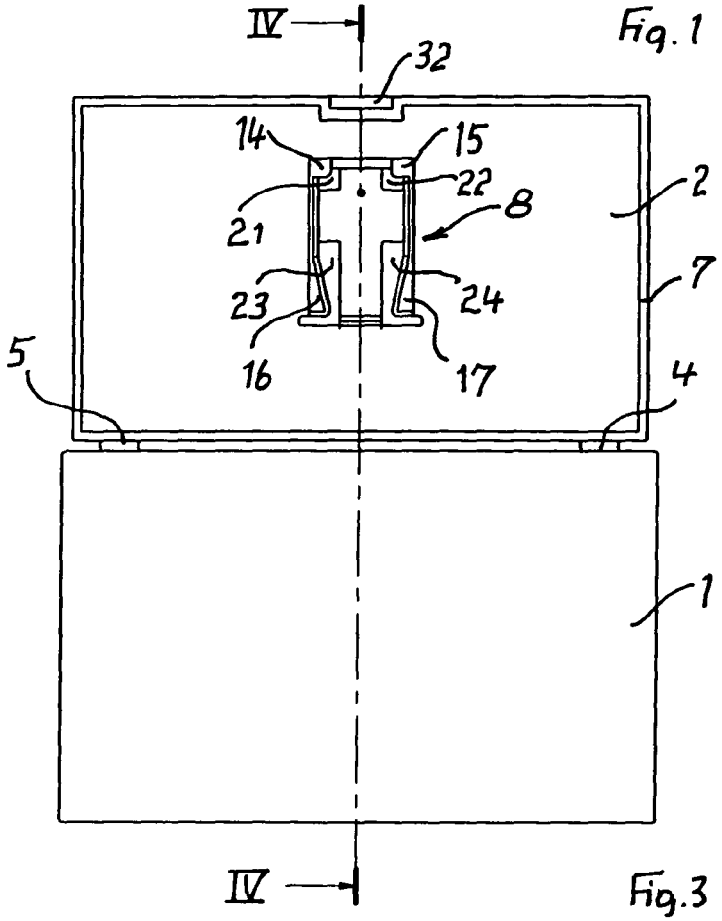
Figure 4:
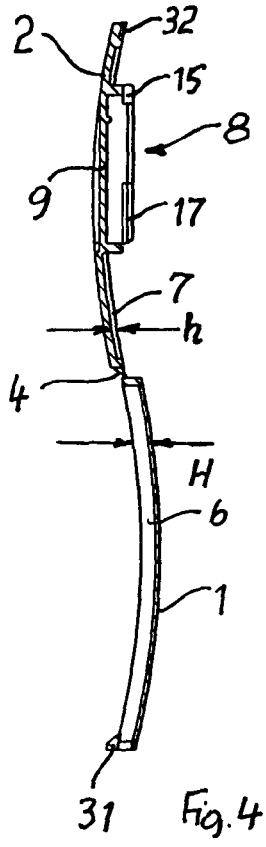
Figure 5:
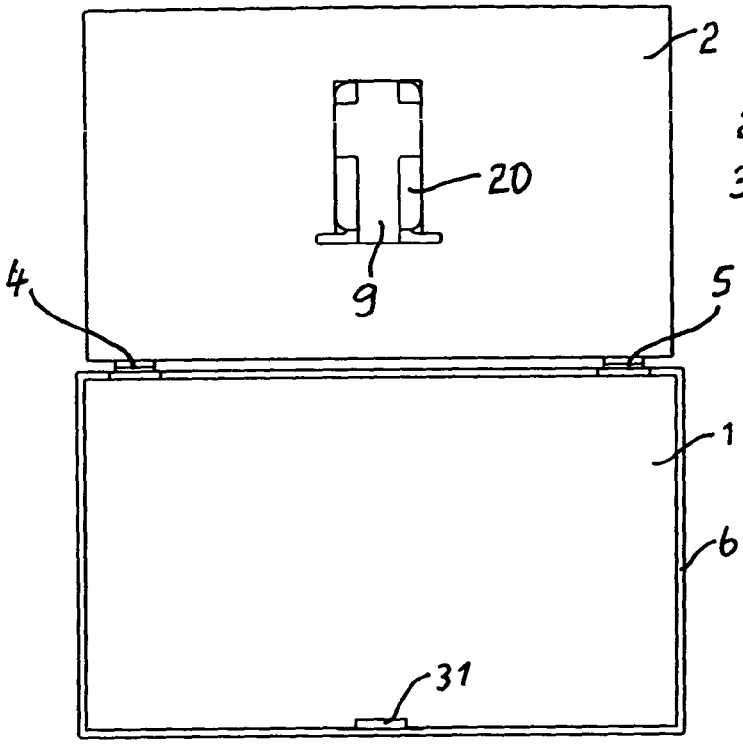
Figure 6:
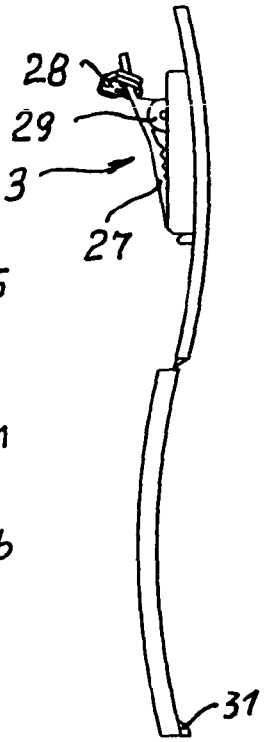
Figure 7:
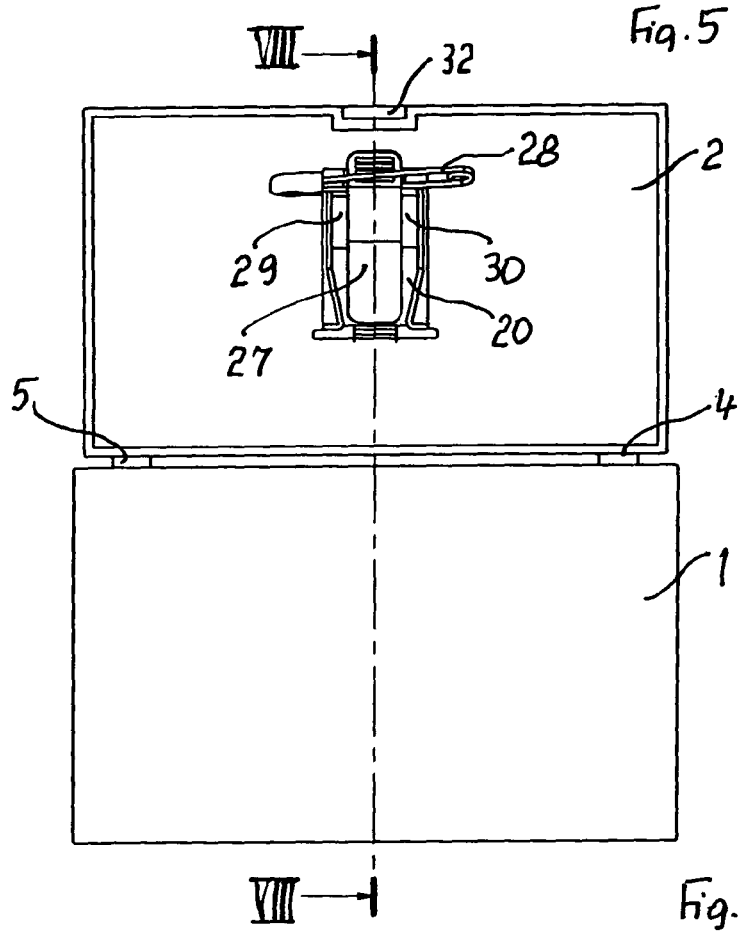
Figure 8:
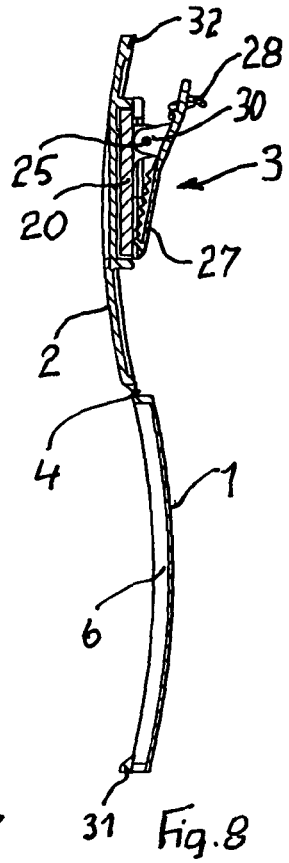
Figure 9:
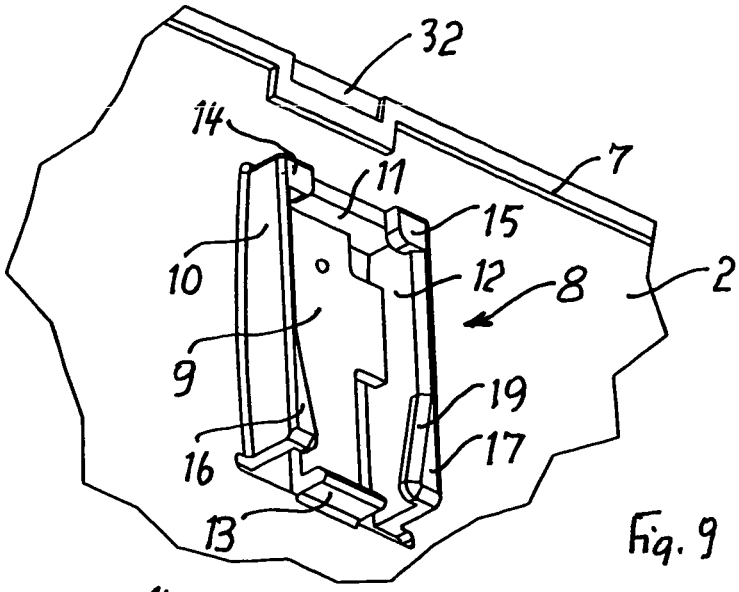
Figure 11:
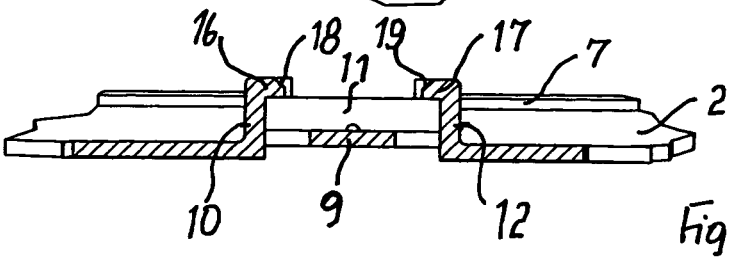
Figure 10:
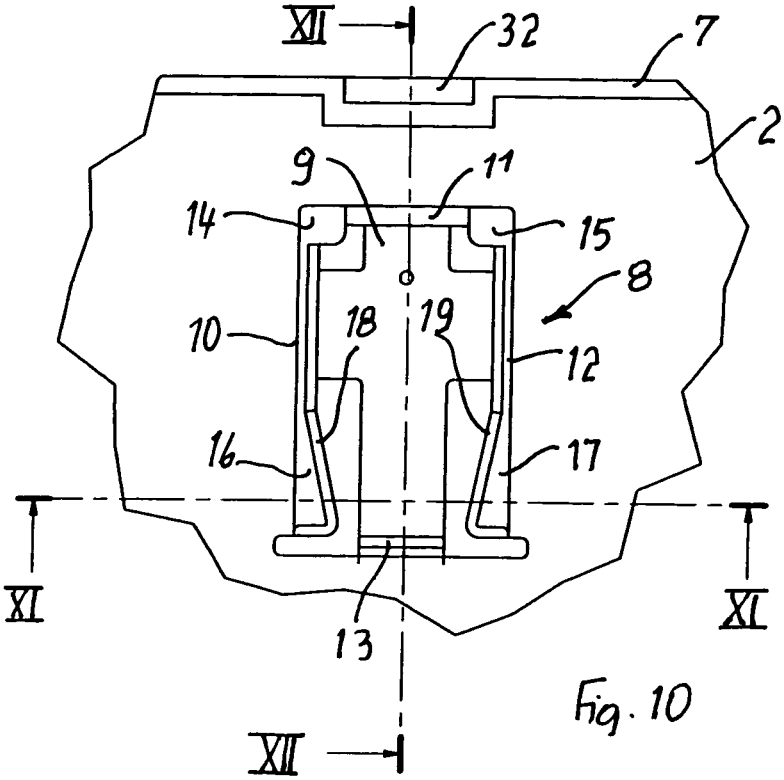
Figure 12:
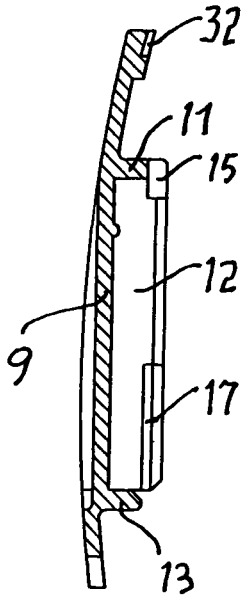

To increase the stiffness of the name badge both the front wall 1 and also the rear wall 2 are slightly curved and are in addition provided with circumferential ridges 6 or 7, wherein the height H of the ridge 6 is greater than the height h of the ridge 7 in order to prevent as far as possible the protrusion of the ridge 7 beyond the ridge 6 when the name badge is closed. The ridge 6 of the front wall 1 here forms a frame not only for the rear wall 2, but also for a label, not shown, which consequently cannot be lost.

An integral mounting 8, the structure of which can be seen from FIGS. 9 to 12, is used for the attachment of the attachment device 3, formed as a combination clamp, to the rear wall 2. The mounting 8 has a flat base 9, to which the side walls 10, 11 and 12, which protrude beyond the inner side of the rear wall 2, and a limit stop 13 are connected. At the transitions between the wall 11 and the walls 10 and 12 there are two holding down clamps 14 and 15, which together with two other holding down clamps 16, 17, ensure the secure seating of the attachment device 3 in the mounting 8. The holding down clamps 16 and 17 have oblique guide areas 18, 19, which enable the rectangular base 20 to be clipped into the mounting 8, provided that the material used for the manufacture of the name badge has sufficient elasticity. The base 9 has the shape of a cross, i.e. for reasons of injection moulding it has openings 21, 22, 23 and 24 in the region of the holding down clamps 14 to 17.

Figure 13:
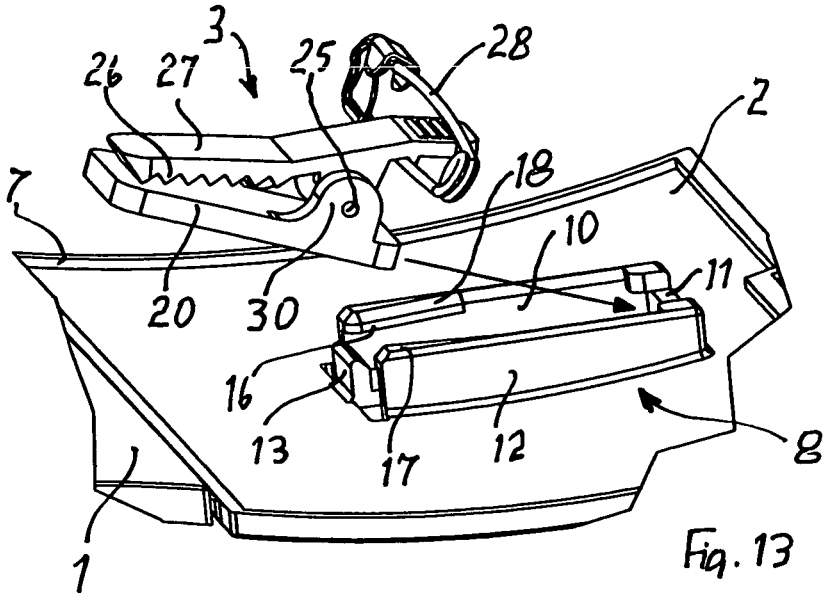
Figure 14:
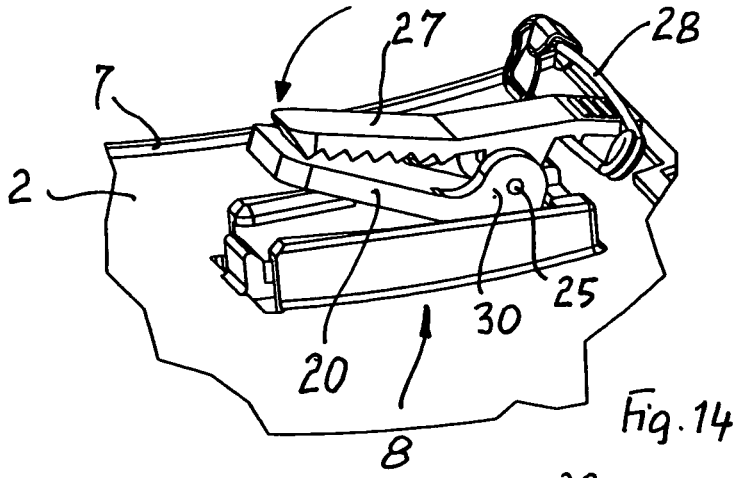
Figure 15:
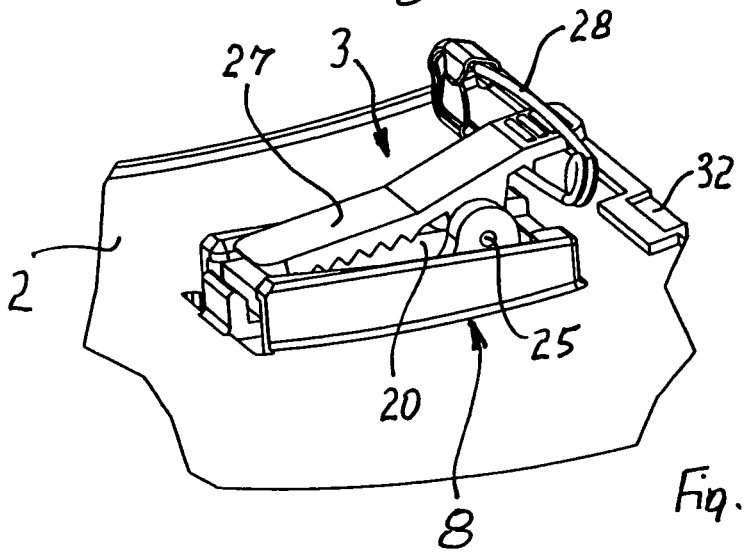
Figure 16:
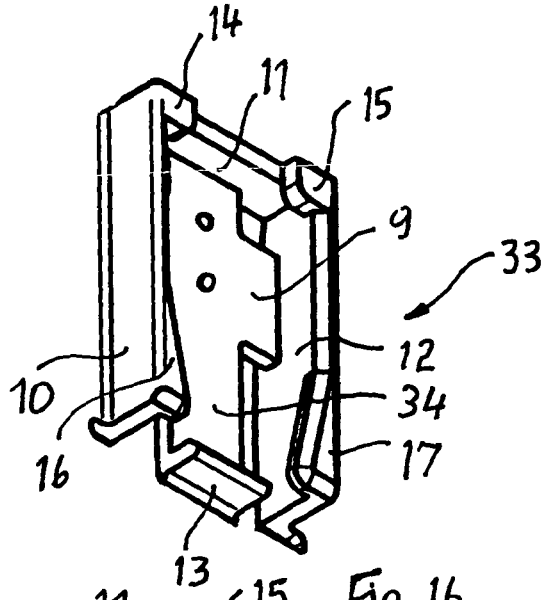
Figure 18:
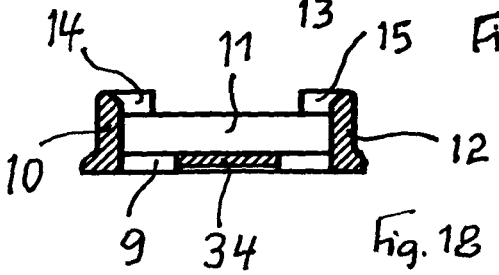

The assembly of the attachment device 3 is illustrated for greater clarity in FIGS. 13 to 15. At the same time, FIGS. 13 to 15 show that the attachment device 3 has a double-arm clamping element 27, supported on a pivot axle 25 and provided with retaining teeth 26, which carries a safety pin 28 at its end orientated away from the retaining teeth 26. The retaining teeth 26 of the clamping element 27 are pressed against the base 20 under the action of a spring, which is not shown. With the attachment device 3 in the clipped-in state the holding down clamps 21 to 24 are located against sections of the base 20 which are located outside of the cheeks 29, 30 in which the pivot axle 25 for the clamping element 27 is supported.

To ensure that the closed parts 1 and 2 keep together a latching connection is used which consists of a hook 31 and a cavity-shaped recess 32, behind which the nose the hook 31 can engage.

FIGS. 16 to 19 illustrate a slightly modified mounting 33 for an attachment device 3, wherein parts corresponding to the parts of the mounting 8 are assigned the same reference numerals as in the previous figures.

In contrast to the mounting 8, with the mounting 33 part of the base 9 forms a sprung-elastic tongue 34 at the free end of which the limit stop 13 is arranged. Since the tongue 34 can be elastically deformed in the direction of the arrow 35, the limit stop 13 can be brought into a position, which facilitates pushing the attachment device 3 into the mounting 33 from the limit stop side. The holding down clamps 14-17 can consequently be as stiff as required. Once the rear wall 2 is connected to the front wall 1, displacement of the tongue in the direction of the arrow 35 is prevented by the front wall 1.

Figure 17:
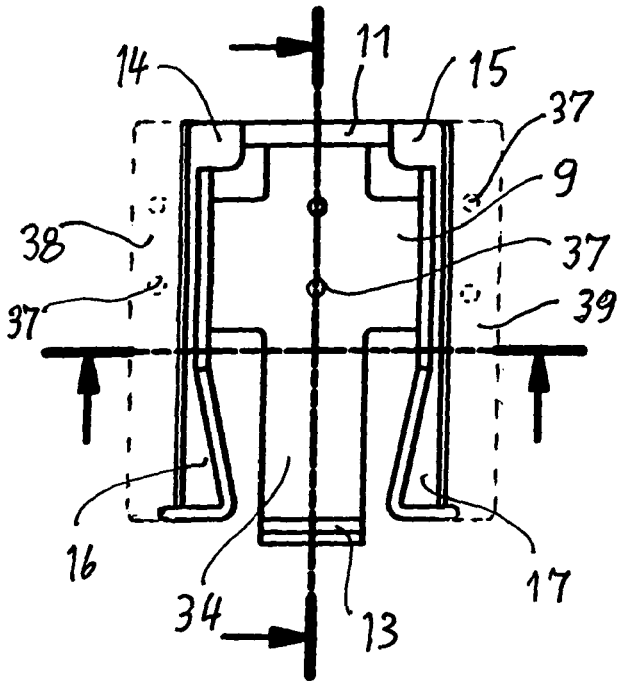
Figure 19:
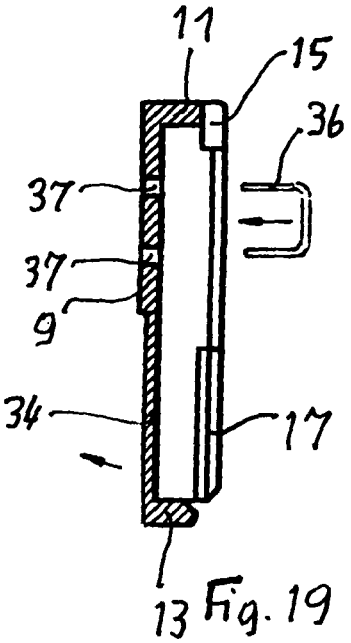

The mounting 33 does not need to be an integral component of the rear wall 2, but can be joined to it also through suitable means. Thus it is for example possible to attach the mounting 33 with the aid of one or several fixing clips 36 to the rear wall of the name badge, which consist of a section of film folded several times. In such cases it has been found to be practicable to either provide holes 37 in the base 9 or to equip the mounting 33, as indicated in FIG. 17 by broken lines, with flanges 38, 39 which have suitable holes 37.

The invention claimed is:

1. Name badge with an attachment device (3) for attaching said name badge to an item of clothing, said attachment device having a base (20) and two cheeks (29, 30) spaced from one another, and a double-armed clamping element (27) supported pivotably on a pivot axle (25) mounted to the cheeks (29, 30), wherein one arm of said double-armed clamping element is pressed against the base (20) by a spring; said name badge further including a mounting (8; 33) for said attachment device, said mounting extending rearwardly from a rear surface of said name badge, said mounting formed as a separate unit comprising a plurality of walls forming a substantially closed frame and a substantially flat bottom base portion for receiving the base of the attachment device within said separate unit, said bottom base portion of said mounting being mounted to a substantially flat portion of said rear surface of said name badge, said frame being provided with holding down clamps (14-17) for engaging portions of the outside of the base (20) of the attachment device when the attachment device is received within the frame.

2. Name badge according to claim 1, characterised in that at least some holding down clamps (16, 17) are elastically deformable.

3. Name badge according to claim 1, characterised in that one of the lateral sides of the frame (10-13) is formed as a limit stop (13), which can be brought into contact with one of the face sides of the base (20) of the attachment device (3) with the said face side extending perpendicular to the cheeks (29, 30).

4. Name badge according to claim 3, characterised in that the region of the ends of the longitudinal sides (10, 12) of the frame (10-13) orientated towards the limit stop (13) two flexible holding down clamps (16, 17) are arranged, which taper in the direction of the ends of the longitudinal sides (10, 12) orientated away from the limit stop (13).

5. Name badge according to claim 3, characterised in that at least one further holding down clamp (14, 15) is arranged in the region of the end of the frame (10-13) orientated away from the limit stop (13).

6. Name badge according to claim 3, characterised in that the limit stop (13) is arranged at the end of an elastic tongue (34), formed by a part of the base (9) of the mounting (33).

7. Name badge according to claim 1, characterised in that the mounting (8) is formed as an integral component of the rear wall (2) of a name badge.

8. Name badge according to claim 1, characterised in that the mounting (8) is formed as an injection moulded part.

9. Name badge according to claim 1, characterised in that the base (9) of the mounting (8; 33) is flat and is provided with openings (21-24) in the region of the holding down clamps (14-17).

10. Name badge according to claim 1, characterised in that the base (9) is provided with holes (37) for accepting the limbs of a fixing clip (36).

11. Name badge according to claim 10, characterised in that the holes (37) are arranged in sections (38, 39) of the base (9) of the mounting (33) located outside of the frame (10-13).

12. Name badge according to claim 1, characterised in that its rear wall (2) bearing the mounting (8) and a transparent front wall (1) consist of two parts, which are kept together by a latching connection (31, 32).

13. Name badge according to claim 12, characterised in that the parts forming the front wall (1) and the rear wall (2) are connected together by at least one pivot hearing (4, 5).

14. Name badge according to claim 2, characterised in that one of the lateral sides of the frame (10-13) is formed as a limit stop (13), which can be brought into contact with one of the face sides of the base (20) of the attachment device (3) with the said face side extending perpendicular to the cheeks (29, 30).

15. Name badge according to claim 4, characterised in that at least one further holding down clamp (14, 15) is arranged in the region of the end of the frame (10-13) orientated away from the limit stop (13).

16. Name badge according to claim 4, characterised in that the limit stop (13) is arranged at the end of an elastic tongue (34), formed by a part of the base (9) of the mounting (33).

17. Name badge according to claim 5, characterised in that the limit stop (13) is arranged at the end of an elastic tongue (34), formed by a part of the base (9) of the mounting (33).

18. Name badge according to claim 14, characterised in that the region of the ends of the longitudinal sides (10, 12) of the frame (10-13) orientated towards the limit stop (13) two flexible holding down clamps (16, 17) are arranged, which taper in the direction of the ends of the longitudinal sides (10, 12) orientated away from the limit stop (13).

19. Name badge according to claim 14, characterised in that at least one further holding down clamp (14, 15) is arranged in the region of the end of the frame (10-13) orientated away from the limit stop (13).

20. Name badge according to claim 14, characterised in that the limit stop (13) is arranged at the end of an elastic tongue (34), formed by a part of the base (9) of the mounting (33).

21. Name badge according to claim 1, characterised in that sidewalls (10-12) protruding beyond the inner side of the rear wall (2) at least partially form said frame.

22. Name badge with an attachment device (3) for attaching said name badge to an item of clothing, said attachment device having a base (20) and two cheeks (29, 30) spaced from one another, and a double-armed clamping element (27) supported pivotably on a pivot axle (25) mounted to the cheeks (29, 30), wherein one arm of said double-armed clamping element is pressed against the base (20) by a spring; said name badge further including a mounting (8; 33) for said attachment device, said mounting extending rearwardly from a rear surface of said name badge; said mounting formed as unit comprising a plurality of walls forming a substantially closed frame, each of said plurality of walls extending beyond the rearmost potion of the rear surface of the name badge, and a bottom base integrally formed from a portion of the rear surface of the name badge for receiving the base of the attachment device within said unit; said frame being provided with holding down clamps (14-17) for engaging portions of the outside of the base (20) of the attachment device when the attachment device is received within the frame.

* * * * *